United States Patent [19]

Obear

[11] 4,283,886

[45] * Aug. 18, 1981

[54] WORKPIECE CONDITIONING GRINDER SYSTEM

[75] Inventor: Robert F. Obear, Everett, Wash.

[73] Assignee: Western Gear Corporation, Everett, Wash.

[ * ] Notice: The portion of the term of this patent subsequent to Jul. 1, 1997, has been disclaimed.

[21] Appl. No.: 80,927

[22] Filed: Oct. 1, 1979

Related U.S. Application Data

[60] Continuation of Ser. No. 810,520, Jun. 27, 1977, Pat. No. 4,209,948, which is a division of Ser. No. 748,293, Dec. 7, 1976, Pat. No. 4,100,700.

[51] Int. Cl.[3] ..... B24B 7/02

[52] U.S. Cl. ..... 51/92 R

[58] Field of Search ..... 51/37, 38, 45, 68, 92 R, 51/99, 100 P, 126, 165.92, 34 D, 34 G, 47, 166 MH; 409/193, 201, 202, 236

[56] References Cited

U.S. PATENT DOCUMENTS

| | | | |
|---|---|---|---|
| 1,972,217 | 9/1934 | Dunbar | 51/99 |
| 2,442,042 | 5/1948 | Hamilton | 51/99 X |
| 2,982,056 | 5/1961 | Edgvist | 51/99 X |
| 3,149,439 | 9/1964 | Beattie | 51/92 R X |
| 3,641,709 | 2/1972 | Gazuit | 51/99 X |
| 3,667,165 | 6/1972 | McDowell | 51/35 |
| 3,838,541 | 10/1974 | Durst | 51/99 X |
| 4,085,547 | 4/1978 | Lawson | 51/47 |
| 4,209,948 | 7/1980 | Obear | 51/92 R |

FOREIGN PATENT DOCUMENTS

| | | | |
|---|---|---|---|
| 541258 | 3/1956 | Italy | 51/99 |

*Primary Examiner*—Gary L. Smith

*Attorney, Agent, or Firm*—Seed, Berry, Vernon & Baynham

[57] ABSTRACT

An elongated metal workpiece such as a slab or billet is moved longitudinally beneath a grinding head by a reciprocating carriage mounted on an elongated track. The carriage receives a billet from a charging table, reciprocates the billet beneath the grinding head for a plurality of grinding passes, and then delivers the finished billet to a discharge table. The grinder head includes a rotating grinding wheel mounted at the end of a first arm which is pivotally secured to one end of a pivotally mounted second arm. The vertical position of the grinding wheel, and hence the downward force exerted by the grinding wheel on the billet, is principally determined by the angular position and torque, respectively, of the first arm while the horizontal position of the grinding wheel transverse to the longitudinal axis of the billet is principally determined by the angular position of the second arm. Grinding wheel vibration is limited by clamping the second arm to a massive, rigid foundation during each grinding pass thereby limiting the movement of the grinding head to a single degree of freedom. The grinding head and carriage are instrumented with transducers for measuring such parameters as grinding wheel driving torque and speed, carriage position and speed, and grinding wheel position to automatically remove a surface layer having a preselected thickness in accordance with a manually selected value representing desired thickness and the energy required to remove a unit volume of billet material at a given rate under specific operating conditions.

4 Claims, 8 Drawing Figures

WORKPIECE CONDITIONING GRINDER SYSTEM

The instant application is a continuation of application Ser. No. 810,520 filed June 27, 1977 now U.S. Pat. No. 4,209,948, which is in turn a division of earlier filed application Ser. No. 748,293, filed Dec. 7, 1976, now U.S. Pat. No. 4,100,700.

BACKGROUND OF THE INVENTION

1. Field of the Invention

This invention relates to metal grinding machines and, more particularly, to a grinding machine for automatically removing a surface layer of material having a precisely selected thickness from elongated metal workpieces in preparation for a subsequent operation.

2. Description of the Prior Art

Semi-finished, elongated workpieces such as steel slabs or billets are invariably coated with a fairly thin layer of oxides or other impurities which may extend into the billet a considerable distance and defects consisting usually of longitudinal cracks at localized points on the surface of the billets. These impurities must be removed before the billets are rolled into finished products since the impurities and defects would otherwise appear in the finished product. Cracks particularly must be removed as subsequent operations invariably enlarge them. Billet grinders utilizing a reciprocating carriage for moving the billet longitudinally beneath a rotating grinding wheel or for moving the grinding wheel longitudinally above the billet have long been used to perform these functions. The relatively thin layer is removed by a "skinning" procedure in which the billet reciprocates beneath the grinding wheel with the grinding wheel moving transversely after each reciprocation or grinding pass until the entire surface of the billet has been covered. Relatively deep impurities and defects are then visually apparent, and they are removed by a "spotting" procedure in which the grinding wheel is held in contact with the localized area until all of the impurities have been removed.

Various techniques have been devised to automate the skinning procedure by automatically reciprocating the billet beneath the grinding wheel and moving the grinding wheel transversely an incremental distance each grinding pass until the entire surface has been covered. The basic problem with these systems has been their inability to remove a constant depth of material at a rapid rate particularly from non straight workpiece surfaces thus either severely limiting the speed at which workpieces are conditioned or removing an excess quantity of metal from workpieces. These problems are principally due to excessive wheel vibration caused by exposure of sliding ways to abrasive environment and resulting wear which reduces grinding wheel contact with the workpiece and the use of control systems having a relatively slow response time which are thus incapable of responding to irregular workpiece surfaces at a sufficient rate.

SUMMARY OF THE INVENTION

It is an object of the invention to provide a grinding machine which uniformly removes surface layers of a precisely selected thickness from elongated workpieces having an irregular surface contour.

It is another object of the invention to provide a grinding machine capable of high production throughput without sacrificing performance by limiting grinding wheel vibration through the use of zero play pivoting arms and providing a fast response control system.

It is still another object of the invention to provide a grinding machine which automatically removes a layer of material from the surface of elongated workpieces with a minimum operator assistance.

It is a further object of the invention to provide a control system which allows the grinding machine to grind a variety of workpiece materials with accurately predicted and repeatable results.

These and other objects of the invention are accomplished by a grinding machine having a fast response time control system for controlling the downward force of a grinding head against the elongated workpiece so that the system is capable of removing a precisely selected depth of material at a rapid rate. The workpiece is carried by a carriage which automatically reciprocates between two semi-automatic selected limits, and the velocity of the carriage therebetween is controlled to provide substantially constant acceleration below a predetermined velocity limit. The optimum transverse width of the cut is then calculated in accordance with a predetermined depth-of-cut to utilize a maximum available power of the prime mover rotating the grinding wheel and each transverse incremental advance of the grinding wheel is controlled to make the actual transverse width of cut substantially the same. The control system measures the transverse width of the grinding cut and combines this measurement with a manually selected depth-of-cut input to determine the cross-sectional area of the cut. The longitudinal velocity of the workpiece is then combined with the area of the cut to provide an indication of the volume of material removed per unit of time. Finally, this rate of removal indication is combined with a manually selected input corresponding to the energy required to remove a unit volume of workpiece material under specific operating conditions to generate a signal indicative of the required power at each instant of time. The required grinding head drive torque is then computed by dividing the required power signal by the rotational velocity of the grinding head. The actual drive torque is measured and compared with the required torque to adjust the downward force of the grinding head on the workpiece so that the actual torque is equal to the required torque. This highly responsive control system, in combination with a mechanical damping system which clamps a portion of the grinding head support structure to a rigid, massive foundation during each grinding pass to reduce vibration and hence increase wheel contact, allows the grinding system to remove a precisely selected depth of cut from irregularly contoured workpieces at an extremely fast rate.

DETAILED DESCRIPTION OF THE PREFERRED EMBODIMENTS

Figure 1:
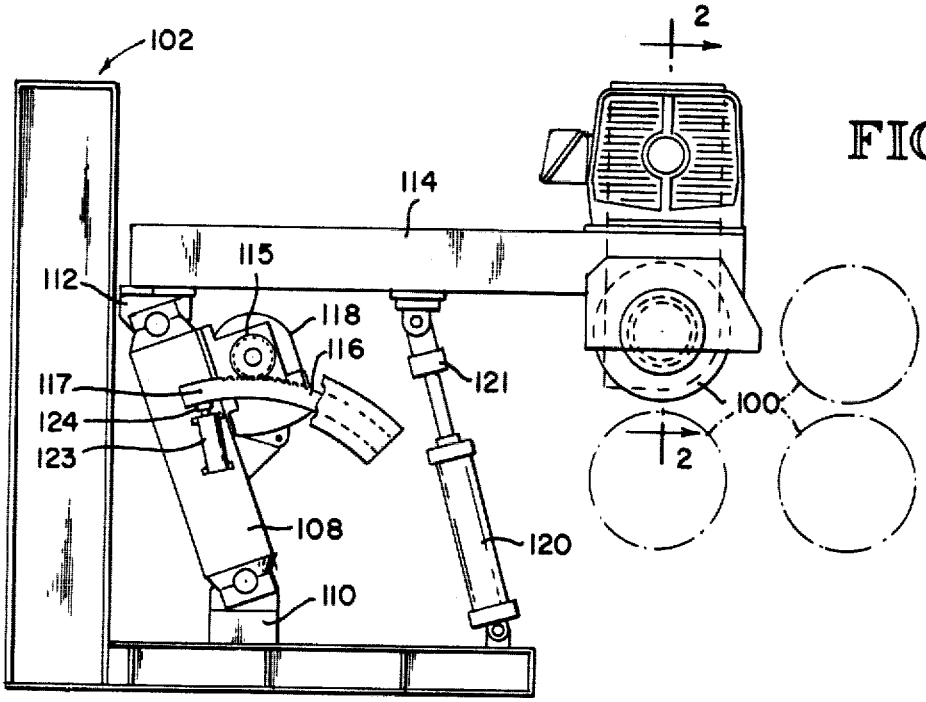
FIG. 1 is a cross-section view of the billet grinding machine taken along the line 1—1 of FIG. 3
Figure 2:
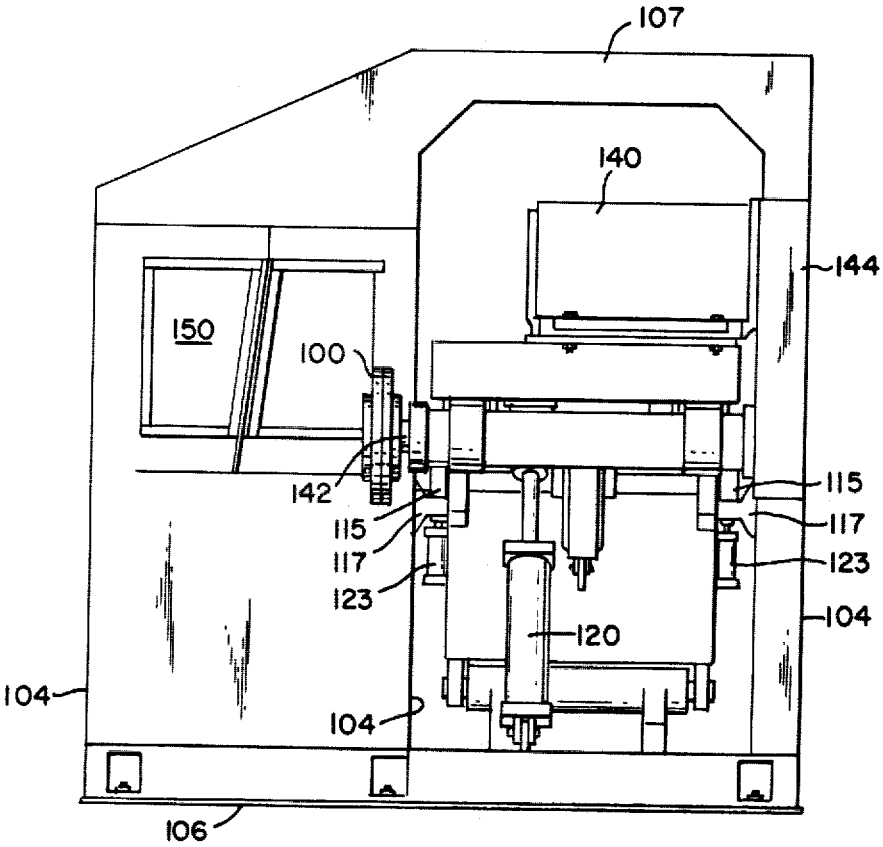
FIG. 2 is a cross-sectional view of the billet grinding machine taken along the line 2—2 of FIG. 1.
Figure 3:
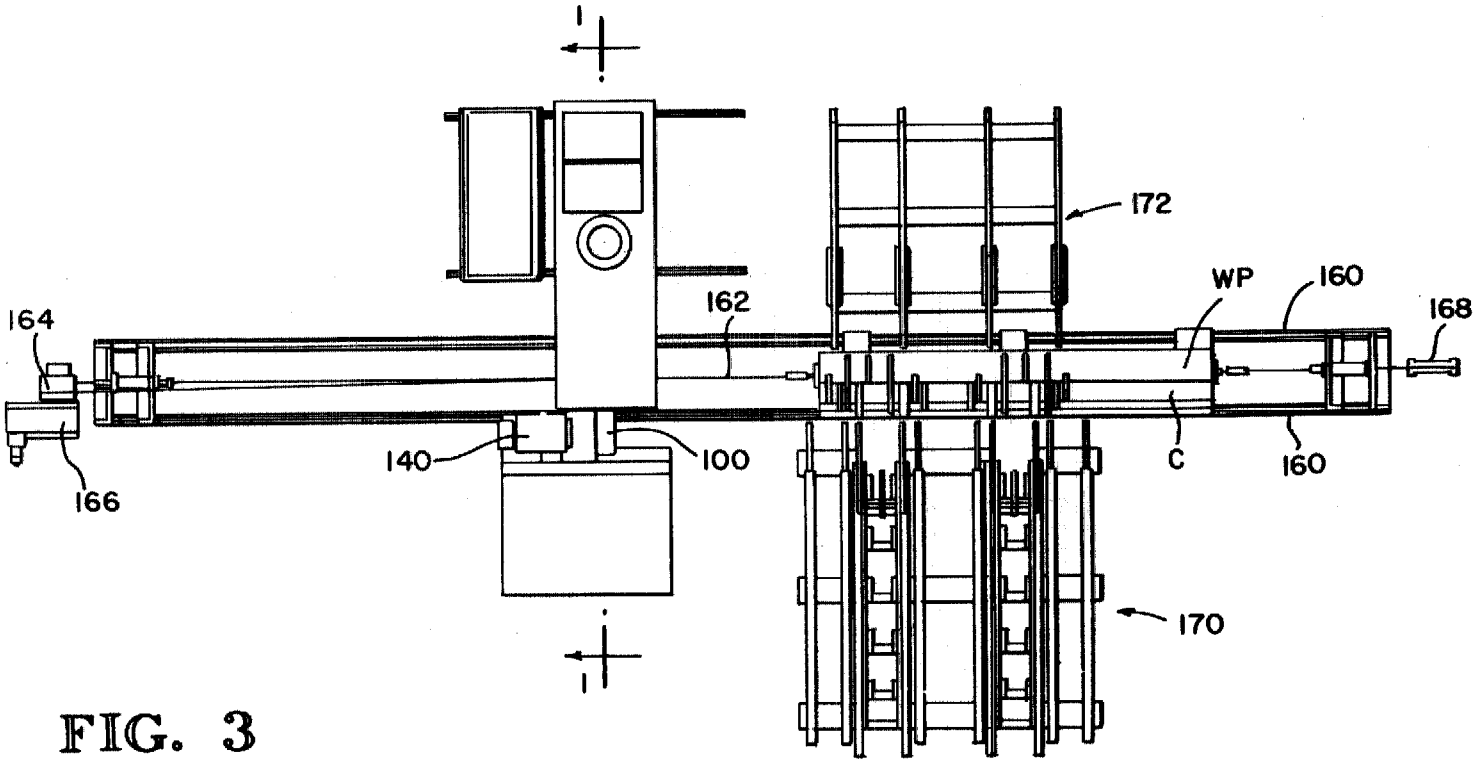
FIG. 3 is a top plan view of the billet grinding machine including the carriage for supporting the workpiece and the charge and discharge tables for loading the workpiece on and off the carriage.

The grinding apparatus including the means for moving the grinding head 100 is best shown in FIGS. 1–3 and includes a stationary, rigid frame 102 comprised of massive side frame members 104, a floor frame 106 and a roof frame 107. The side frames 104 are preferably formed from a conventional laminated concrete construction filled on site to provide a weight in excess of 60,000 pounds such that the massive weight of the frame provides extreme rigidity to the side frame members.

Positioned between two side frame members is a pivotal support 108 which is pivotally mounted to a bracket 110 rigidly connected to the bottom frame 106. The upper end of the pivotal support is connected to a bracket 112 that is rigidly connected to a pivotal arm 114. The opposite end of the pivotal arm 114 mounts the grinding head 100. The pivotal support 108 is positioned by a hydraulically driven set of pinion gears 115 that mesh with rack gears 116. The rack gears 116 lie on an arc coincident with the arc of movement of the pivotal support 108 and are connected to rigid side bars 117 that are connected to the massive side frame members 104. Rotation of the reversible hydraulic motor 118 will move the pinions along the racks to position the arm 108 and thus position the driving head transversely across a workpiece WP carried on a movable carriage C.

The vertical movement of the rotary head 100 is controlled by an hydraulic cylinder 120 pivotally connected to the base frame 106 and having a piston rod 121 that is pivotally connected to the pivotal arm 114 approximately at its midpoint. The combined movements of the hydraulic motor 118 and the hydraulic cylinder 120 can position the grinding head 100 in an infinitely variable number of positions such as shown by the phantom lines drawings in FIG. 1. Control of the hydraulic motor and cylinder are described elsewhere in the application.

It is an important feature of this embodiment of the invention that the grinding head be extremely well dampened to reduce vibration. Conventional billet grinders, for example, are mounted on guideways or other linkage mechanisms initially and over prolonged use in the highly abrasive dust environment become quite sloppy in their connections allowing the grinding head to vibrate on the workpiece. It is estimated that the efficiency of present day conditioning grinders, for example, is between 20 and 30% of ideal.

Vibration is considered to be one of the largest problems causing limited grinding wheel life and substandard surface finishes on the workpiece. Also, vibration tends to be one of the major causes of structural deterioration of the grinding disc itself. In this embodiment of the invention, rigid, massive structural design and vibrational "sink" construction reduces the vibrations to a minimum. By reducing vibration the grinding wheel can be maintained in contact with the billet for a longer period through each revolution. This will result in more horsepower being transferred effectively to the grinding process at any specific grinding head load. The reduction of vibration maintains a proportionately rounder wheel during the life of the grinding wheel. The optimized contact time permits faster traverse speeds by the workpiece and increases wheel life by the reduction of shock load and excessive localized heating.

Since the massive side frame members 104 will provide the structural rigidity to the frame, it is a unique feature of this embodiment of the invention that the pivot connection between the pivotal arm 114 and the pivotal support 108 is locked directly to the side frame members so that the pivotal arm pivots directly from the side frame in the grinding mode rather than through the motion connections of the traversing pivotal support 108. For this purpose the pivotal support has rigidly connected therewith a pair of locking cylinders 123. The locking cylinders are provided with clamping piston rods 124 that engage the underside of the side bars 117. Consequently, the pivotal support 108 becomes rigidly connected to the side frame members 104 at its side surfaces rather than solely through its pivotal connection on the bracket 110. Thus the pivotal connection to the bracket 110 becomes isolated and does not enter in as an extended connection which can provide vibration motion to the grinding head. The rigidifying of the pivotal connection for the pivotal arm 114 also provides the further advantage of having faster response time for movements of the grinding head in response to changes in variations of the surface of the workpiece since the only motion possible to the grinding head is in a single direction. With motion occurring in two axes, one of which being the traversing mechanism, such as in conventional grinders non-linear errors arise in the control forcing a response rate to be slowed in order to maintain accurate control of the position and pressure of the grinding wheel. The grinding head is preferably powered by an electric motor 140 that drives a spindle 142 through a gear train 144. Preferably the grinding wheel is cantilevered out to one side so that it is directly visible by an operator at a viewing window 150.

The overall grinder machine including the mechanism for reciprocating the workpiece WP is best illustrated in FIG. 3. The workpiece WP is supported on a conventional carriage C having a set of wheels (not shown) which roll along a pair of elongated tracks 160. A cable 162 connected to one end of the carriage C engages a drum 164 which, as explained hereinafter, is selectively rotated by a hydraulic motor 166 or hydrostatic drive. The cable 162 extends beneath the track 160 and engages a freely rotating sheave 168 at the other end of the track 160 and is then secured to the opposite end of the carriage C. Thus rotation of the drum 164 moves the carriage C along the track 160.

In operation, a workpiece such as a billet is initially placed on a conventional charge table 170. The carriage C is then moved along the track 160 to a charging position adjacent the charge table 170 and the workpiece is loaded onto the carriage C by conventional handling means. The carriage C then moves toward the grinding head 100 and the grinding head 100 is lowered into contact with the workpiece WP. The workpiece WP then reciprocates beneath the grinding head 100 for a plurality of grinding passes with the grinding head moving transversely across the workpiece an incremental amount for each reciprocation until the entire surface of the workpiece WP has been ground. The carriage C is finally moved to a discharge position where the workpiece WP is loaded onto a conventional discharge table 172 by conventional handling means.

As explained hereinafter, the grinding machine may be operated in one of three modes. In an "auto skinning" mode the carriage automatically reciprocates beneath the grinder head 100 with the vertical position of the grinding head being automatically controlled to follow the surface contour of the workpiece. After each longitudinal movement of the workpiece, the grinding head 100 is moved transverse to the longitudinal axis of the workpiece WP a small increment until the entire surface of the workpiece has been ground. Conventional workpiece manipulating mechanisms on the carriage C then rotate the workpiece to allow the grinding head 100 to condition each of the surfaces. The finished workpiece is then delivered to the discharge table 172, and the carriage C receives a new workpiece from the charge table 170. The automatic skinning mode may only be selected if the workpiece left and right end limits have been set so that the carriage is capable of automatically moving between the left and right end limits. Head power or torque is automatically adjusted as a function of carriage speed in order to maintain a constant preselected depth of cut.

In a "manual skinning" mode the velocity of the carriage C and the transverse velocity of the grinding head 100 are manually controlled by the operator. However, the vertical position of the grinding head 100 and the pressure of the grinding head 100 against the workpiece WP are automatically controlled in accordance with the velocity of the carriage C in order to maintain the depth-of-cut constant. As carriage speed is increased or decreased according to operator commands, the power or torque of the grinding head 100 against the workpiece WP is automatically adjusted to maintain the preselected depth-of-cut.

In a "manual spotting" mode the vertical position and downward force of the grinding head 100 as well as the carriage speed and transverse position of the grinding head 100 are manually controlled by the operator. The automatic and manual skinning modes are utilized to remove the relatively constant thickness scale and shallow imperfections from the surface of the workpiece, while the manual spotting mode is utilized to remove relatively deep imperfections in the workpiece prior to a rolling operation.

Figure 4:
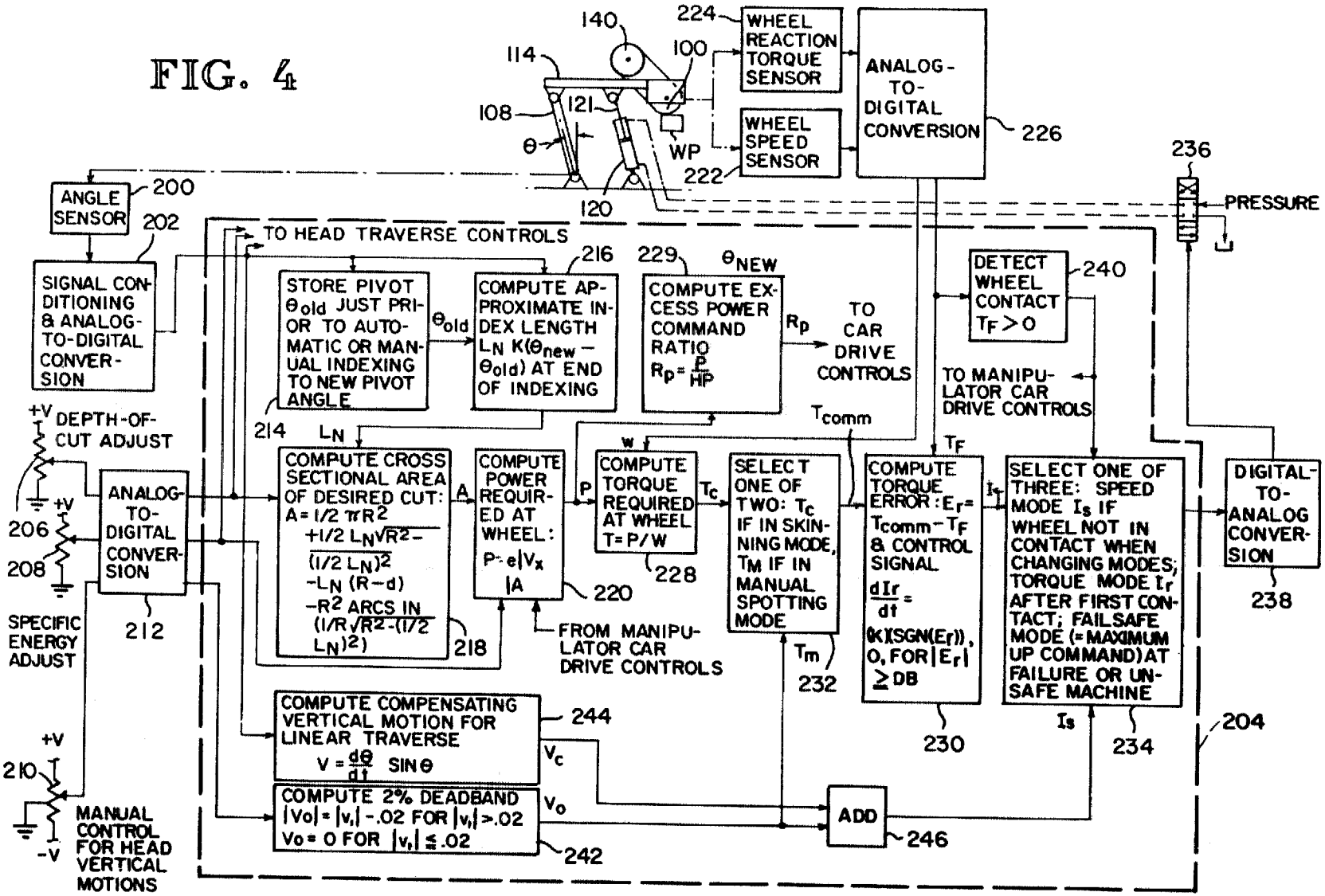
FIG. 4 is a schematic and block diagram of the grinder head vertical axis control system.

The grinder head vertical axis control system for regulating the vertical position of the grinding head 100 and the force of the grinding head 100 against the workpiece WP is illustrated in FIG. 4. The angle $\theta$ of the arm 108 with respect to a vertical reference is measured by an angle sensor 200 such as a conventional encoder, potentiometer, synchro or resolver, rotary variable differential transformer or similar device, and applied it to a signal conditioning and analog to digital conversion circuit 202 which utilizes conventional circuitry to convert the output of the angle sensor 200 into digital form suitable for input to a microprocessor 204. The specific circuitry utilized in the conventional signal conditioning and analog to digital conversion device 202 will, of course, depend upon the specific angle sensor 200 utilized. Similarly, a potentiometer 206 calibrated in depth-of-cut is utilized to manually select the depth to which the grinding head 100 removes material from the workpiece WP, a potentiometer 208 calibrated in specific energy is utilized to provide an indication of such specific operating conditions as the hardness and other physical properties of the workpiece WP and the type and rotational velocity of the grinding head 100. A potentiometer 210 which may be actuated by a "joy stick" is adjusted to control the vertical velocity of the grinding head 100 in the manual spotting mode as explained hereinafter. The outputs from the potentiometers 206–210 are applied to an analog to digital conversion device 212 which converts the analog voltage inputs to a digital indication corresponding thereto. The outputs of the devices 202,212 are applied to a conventional microcomputer 204 which includes such hardware as a central processing unit, program and scratch pad memories, timing and control circuitry, input-output interface devices and other conventional digital subsystems necessary to the operation of the central processing unit. The microcomputer 204 operates according to a computer program produced according to the flow chart enclosed by the indicated periphery of the microcomputer 204. The transverse dimension of each longitudinal cut produced by the grinding head 100 along the longitudinal axis of the workpiece WP is determined by storing the transverse position of the grinding head 100 at 214 which is proportional to $\theta_{OLD}$ the angular position of the arm 108 with respect to the vertical prior to moving the grinding head 100 transversely for the subsequent longitudinal cut. As explained hereinafter, the grinding head 100 is then moved transversely producing a new position indication corresponding to a new angular position $\theta_{NEW}$ of the arm 108 with respect to the vertical. The approximate length of the transverse movement is computed at 216 according to the formula $L_N = K(\theta_{NEW} - \theta_{OLD})$ where $L_N$ is the length of the transverse movement and K is a constant representing the the transverse movement of arm 114 responsive to a given variation in the angle $\theta$ of arm 108 with respect to the vertical. The area of the cut is then calculated at 218 according to the formula:

$$A = \tfrac{1}{2}\pi R^2 + \tfrac{1}{2}Ln\sqrt{R^2 - (\tfrac{1}{2}Ln)^2} - Ln(R - d) - R^2 \mathrm{Arcsin}\left(\frac{1}{R}\sqrt{R^2 - (\tfrac{1}{2}Ln)^2}\right)$$

where R is the radius of the grinding head 100 and d is the depth-of-cut selected by the potentiometer 206. Since the specific energy input e selected by the potentiometer 208 corresponds to the energy required to remove a unit volume of workpiece material under specific grinding conditions, such as the type of grinding head, the rotational velocity of the grinding head and the radius of the grinding head, the power required to remove a unit volume of workpiece material at a given rate can be calculated at 220 according to the formula $P = e|V_X|A$ where e is the specific energy selected by potentiometer 208, $V_X$ is the velocity of the workpiece WP with respect to the grinding head 100 along the longitudinal axis of the workpiece WP, and A is the cross-sectional area of the cut computed at 218. The required power P is then compared with the actual mechanical power transmitted to the grinding head 100 in order to control the grinding force, i.e. the force of the grinding head against the workpiece WP in a direction normal to the surface of the workpiece WP. Although power sensing devices have been used in conventional grinding machines in order to control the grinding force, these power sensing devices have generally been ammeters watt meters applied to measure prime mover input power which are unsatisfactory for a number of reasons. The primary disadvantage of sensing the electrical power delivered to a grinding head motor is the nonlinearity between motor power and the mechanical power actually transmitted to the grinding head 100. For example, when the grinding head 100 is not in contact with the workpiece WP the power transmitted to the grinding head 100 is zero but the electric motor continues to consume a finite amount of power. When the grinding head 100 makes contact with the workpiece WP the mechanical power transmitted to the grinding head 100 increases, but the ratio of the mechanical power to electrical power does not remain constant for all variations of mechanical power transmitted to the grinding head 100. Thus, the variable efficiency of the electric motor produces a nonlinear power measurement in conventional grinder machines utilizing a watt meter to control the grinding force. Furthermore, conventional watt meters do not compensate for the inertia of the drive train since the drive train may momentarily deliver mechanical power to the grinding head 100 without consuming electrical power thereby reducing the response time of such systems. These aforementioned problems are eliminated in the inventive grinder machine by directly measuring the mechanical power transmitted to the grinding head 100. For this purpose, the rotational velocity of the grinding head 100 is measured by a conventional wheel speed sensor 222, such as a tachometer, and the torque of the spindle driving the grinding head 100 is measured by a conventional wheel reaction torque sensor 224, such as a load pin. The outputs of sensors 222,224 are processed by a conventional analog to digital conversion device 226 and applied to the microcomputer 204. Although the rotational speed of the grinding head 100 can be combined directly with the torque transmitted to the grinding head 100 in the microcomputer 204 to generate a mechanical power indication which can then be compared to the required power indication from 220, this comparision can also be made separately by first comparing the rotational velocity of the grinding head 100 with the required power, and then comparing the resulting required torque with the torque transmitted to the grinding head 100. The torque required to provide the required power is calculated at 228 by computing the ratio of the required power to the rotational velocity $\omega$ of the grinding head 100 to generate a required torque indication $T_C$. In the skinning mode the torque $T_C$ is applied directly to a torque error computer 230 by selecter 232. The torque error computer generates a control signal $I_T$ the derivative of which is equal to zero for a torque error $E_T$ less than a predetermined value, is equal to a positive constant for a positive torque error $E_T$, and is equal to a negative constant for a negative torque error $E_T$ where the torque error $E_T$ is the difference between the required torque $T_{COMM}$ as selected at 232 and the actual measured torque $T_F$. Thus the control signal $I_T$ increases linearly with respect to time when the error signal $E_T$ is positive and has a magnitude above the predetermined value, decreases linearly with respect to time when the error signal $E_T$ is negative and has a magnitude above a predetermined value, and is constant for an error signal $E_T$ of less than the predetermined values. The control signal $I_T$ is then applied to selector block 234 which applies the control signal $I_T$ to a servo valve 236 through a conventional digital to analog conversion circuit 238 after the grinding head 100 has made contact with the workpiece WP. For this purpose a wheel contact detector 240 determines when the torque applied to the grinding heat $T_F$ as measured by the torque sensor 224 is greater than zero and generates a wheel contact indication for gating the control signal $I_T$ to the digital to analog conversion device 238. The control signal $I_T$ thus determines the pressure of the hydraulic fluid applied to the cylinder 120 which in turn determines the grinding force, i.e. the force of the grinding head 100 against the workpiece WP in a direction normal of the surface of the workpiece WP. In summary, the microcomputer 204 determines the torque $T_C$ required to produce a longitudinal cut in the workpiece WP having a preset depth-of-cut as selected by potentiometer 206 at a given workpiece velocity $V_X$, compares the required torque with the actual torque measured by the torque sensor 224 and generates a corrective signal $I_T$ to reduce the error $E_T$ to zero.

The required power calculated at 220 may, at times, exceed the power capacity of the grinding head drive motor 140. In order to prevent either the motor 140 from overloading or the depth-of-cut from being reduced below the preset value the excess power is computed at 229 to generate an excess power indication Rp which is equal to the ratio of the required power computed at 220 to the horsepower capacity of the motor 140. As explained hereinafter, the excess power indication Rp reduces the velocity $V_X$ of the carriage C along the longitudinal axis of the workpiece WP thereby reducing the value of the required power P to a value which the motor 120 is capable of supplying for a preselected depth-of-cut.

In the manual spotting mode the grinding torque is controlled by potentiometer 210 which applies a digital control signal from the output of analog to digital conversion device 212 to the microcomputer 204 and which is used in place of the torque computed at 228 to derive the control signal $I_T$ in the aforesaid manner. In order to prevent the servo valve 236 from being actuated by small offsets in the potentiometer 210 a 2% deadband is provided at 242 so that a command signal $V_O$ is not generated until the potentiometer 210 has been deflected in either direction a predetermined distance.

When the arm 108 is vertical so that $\theta$ is zero, the vertical position of the grinding head 100 remains constant responsive to small variations in the angle $\theta$. However, as $\theta$ increases or decreases, the vertical position of the grinding head 100 changes in response thereto so that the transverse movement of the grinding head 100 across the surface of the workpiece WP causes vertical movement of the grinding head 100. This vertical motion is compensated for at 244 which generates a vertical velocity compensating signal $V_C$ according to the formula $V=(d\theta/dt)\ \mathrm{Sin}\ \theta$. This compensating signal $V_C$ is summed with the command signal $V_O$ at 246 to generate a speed control signal $I_S$ to adjust the vertical speed of the grinding head 100. The compensating signal $V_C$ adjusts the quantity of hydraulic fluid in the cylinder 120 to raise or lower the grinding head 100 to compensate for the vertical movement of the grinding head 100 responsive to angular movement of the arm 108.

Figure 5:
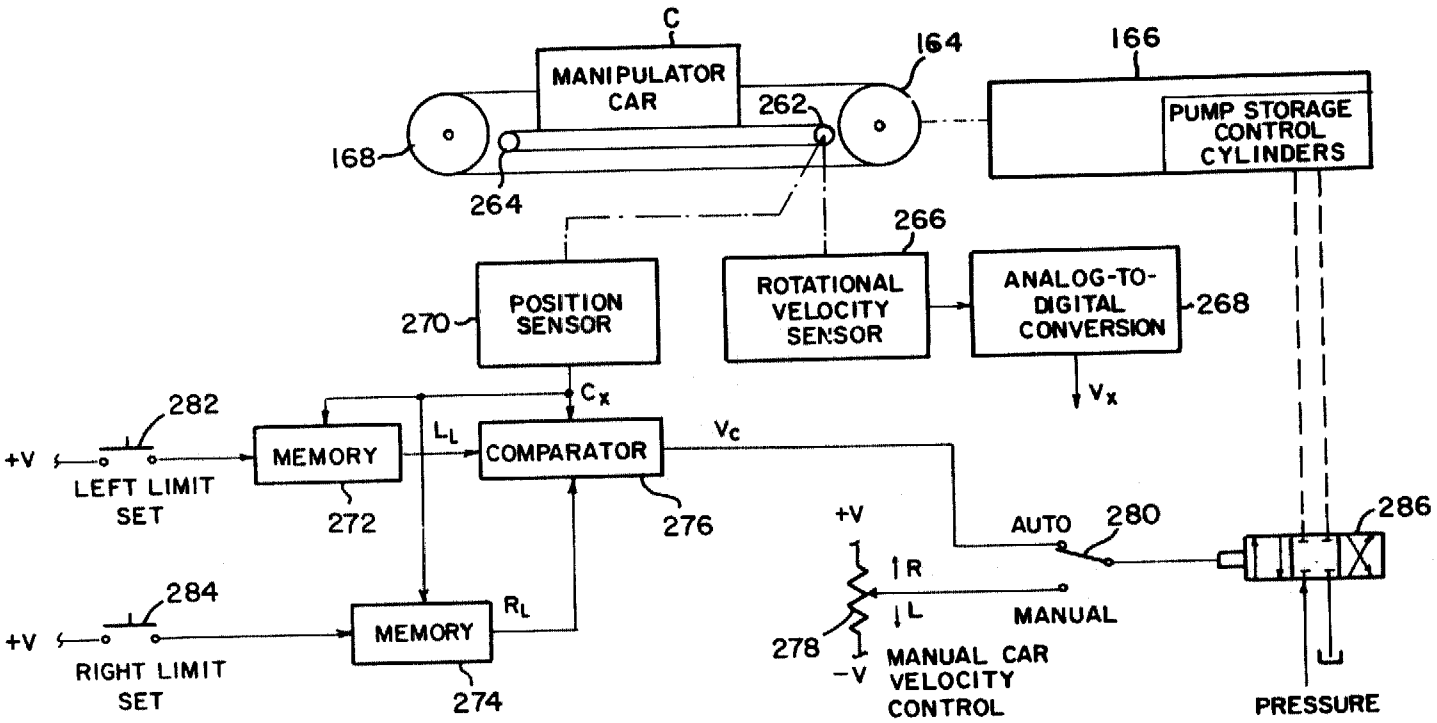
FIG. 5 is a schematic and block diagram of one embodiment of a carriage drive control system.

One embodiment of a carriage drive control system for moving the carriage C along the track 160 is illustrated in FIG. 5. A measurement cable 260 extends from one end of the carriage C, engages a sheave 262 at one end of the rails 160 (FIG. 3), extends along the rails 160 beneath carriage C to engage a sheave 264 at the opposite end of the rails 160, and is secured to the opposite end of the carriage C. The sheave 262 rotates a rotational velocity sensor 266, such as a tachometer, which is converted to a digital indication $V_X$ indicative of the rotational velocity of the sheave 262, and hence the linear velocity of the carriage C, by a conventional analog to digital conversion device 268. The signal $V_X$ is then used to compute the required power at 220 in the microcomputer 204 (FIG. 4). The sheave 262 also rotates a digital position sensor 270, such as a conventional encoder, which produces a digital position indication $C_X$. The position indication $C_X$ is applied to a pair of memory devices 272,274 as well as a conventional comparator 276. In operation the carriage C is manually moved so that the grinding head 100 is adjacent the left end of the workpiece WP by actuating a manual car velocity control potentiometer 278 when a mode select switch 280 is in the manual position. A left limit set switch 282 is then actuated causing the current position indication $C_X$ to be read into the memory 272. The carriage C is then moved to the left by actuating potentiometer 278 until the grinder head 100 is adjacent the right edge of the workpiece WP at which point a right limit set switch 284 is actuated to read the current value of the carriage position indication $C_X$ into the memory device 274. Thus the positions of the carriage C for the left and right limits of travel are retained in memory devices 272,274, respectively. These limits are applied to a comparator 276 along with the position indication $C_X$ to generate a car velocity command $V_C$ which is applied to a servo valve 286 when the mode switch 280 is in its automatic position. The comparator 276 compares the position sensing indication $C_X$ with either the left limit $L_L$ or the right limit $R_L$ and generates a command signal $V_C$ which moves the carriage C to the left or right, respectively. When the carriage reaches one limit value, the left end of the workpiece for example, the comparator then compares the position of the carriage $C_X$ with the right limit $R_L$ and generates a command signal $V_C$ to move the carriage to the left. When the grinding head is adjacent the left edge of the workpiece WP and $V_C$ is equal to $L_L$, the comparator 276 then compares the position indication $C_X$ with the right limit signal $R_L$ and generates a command signal $V_C$ to move the carriage C to the right. The servo valve 286 allows hydraulic fluid to flow into the hydraulic motor 166 to rotate the capstan 164 in either direction.

Figure 6:
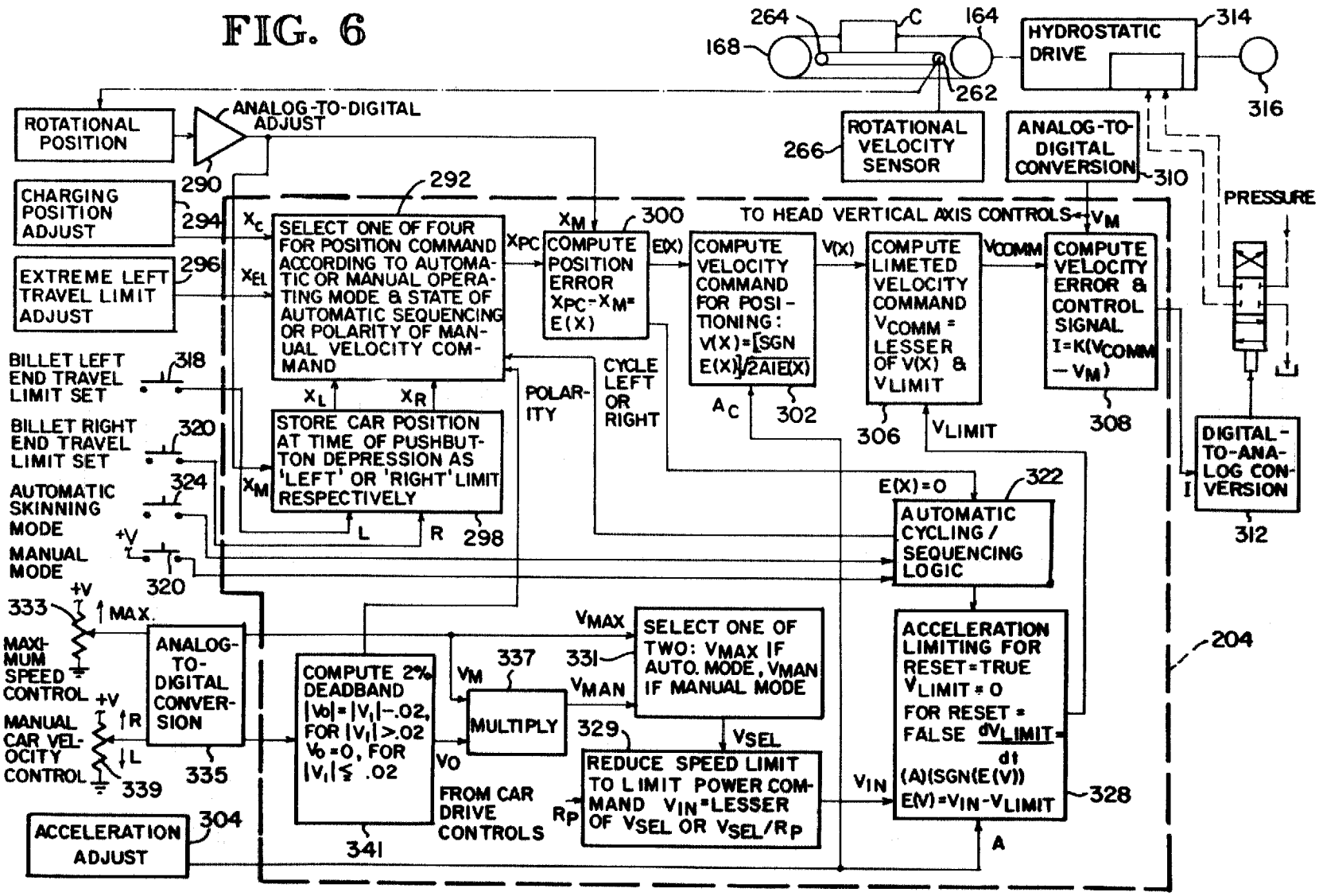
FIG. 6 is a schematic and block diagram of another embodiment of the carriage or manipulator car drive control system.

A more sophisticated carriage drive control system is illustrated in FIG. 6. The instrumentation on the carriage and associated drive circuitry is as illustrated in FIG. 5. The position indication $C_X$ is applied to the microcomputer 204 through an analog to digital conversion device 290. The microprocessor 204 selects a position command $X_{PC}$ at 292 from either a manually entered charge position command $X_C$ as selected by thumbwheel switches 294, an extreme left travel limit command $C_{EL}$ from thumbwheel switches 296, a left limit command $X_L$ from storage 298 or a right limit command signal $X_R$ from storage device 298. The charging position command $X_C$ is selected in a charge mode wherein the carriage c moves to the charging and discharge position as illustrated in FIG. 3. The left and right limits $X_L$, $X_R$, respectively are alternately selected during the automatic skinning mode to cause the carriage C to reciprocate between the left and right positions. A position error E(X) is calculated at 300 by substracting the measured position $X_M$ as determined by the position sensor 270 from the position command $X_{CP}$. A velocity command signal is then calculated at 302 according to the formula $$V(X) = [SGN\ E(X)]\sqrt{2A|E(X)|}$$

where $A_C$ is an acceleration value selected by thumbwheel switch 304. The velocity command V(X) is then applied to a limiter 306 which generates a velocity command $V_{COMM}$ which is the lesser of V(X) and a velocity limit $V_{LIMIT}$. The velocity command $V_{COMM}$ is then compared with a measured velocity indication $V_C$ at 308. The measured velocity indication $V_N$ corresponds to the rotational velocity of the sheave 262 as measured by the rotational velocity sensor 266 and converted to digital form by analog to digital conversion device 310. The carriage drive signal I is converted from digital to analog form by a digital to analog conversion device 312 and applied to the servo valve 286 which controls the pump stroke cylinders of a conventional variable hydrostatic drive 314 which is driven by a prime mover 316.

The velocity limit $V_{LIMIT}$ is generated at 328 according to the formula:

$$\frac{dV_{LIMIT}}{dt} = A[SGN\ (V_{IN} - V_{LIMIT})]$$

where A is a constant manually selected by thumbwheel switches 304 and $V_{IN}$ is a limit command determined as explained below. Thus the velocity limit $V_{LIMIT}$ increases linearly with respect to time when $V_{LIMIT}$ is less than $V_{IN}$ (since $SGN(V_{IN}-V_{LIMIT})$ is then a positive constant), and decreases linearly with respect to time when $V_{LIMIT}$ is greater than $V_{IN}$ (since $SGN(V_{IN}-V_{LIMIT})$ is then a negative constant). Basically, $V_{LIMIT}$ will linearly approach $V_{IN}$ and will then linearly follow any variations of $V_{IN}$. The limit command $V_{IN}$ is computed at 329 and is equal to the lesser of a predetermined velocity limit $V_{SEL}$ generated at 331, or the product of the excess power indication Rp and the limit indication $V_{SEL}$ generated at 331. Thus the velocity limit $V_{LIMIT}$ can never be greater than a carriage velocity which would overload the motor 140 if the preset depth-of-cut were maintained. The limit indication $V_{SEL}$ is a constant $V_{MAX}$ selected by potentiometer 333 and converted by analog to digital conversion device 335 when in the automatic skinning mode. In the manual skinning or spotting modes the limit indication $V_{SEL}$ is computed at 337 as $V_{MAN}$, the product of $V_{MAX}$ and an indication $V_o$ which is manually selected by potentiometer 339 after passing through a deadband calculator 341. Thus the manually actuated potentiometer 339 causes $V_{SEL}$ to be a variable percentage of $V_{MAX}$ as selected by potentiometer 333.

The velocity limit $V_{LIMIT}$ is reset to zero by automatic cycling/sequencing logic 322 when the carriage C reverses direction after each grinding pass so that the carriage velocity of each new pass will increase from zero at the predetermined acceleration rate as $V_{LIMIT}$ linearly approaches.

In the automatic skinning mode the carriage C is manually moved to the left so that the grinder head 100 is adjacent the left edge of the workpiece WP. The left end travel limit set switch 318 is then actuated thereby storing the position indication $X_M$ at that time into storage at 298. The carriage C is then moved to the right until the right edge of the workpiece WP is adjacent the grinder head 100. A right end travel limit set switch 320 is then actuated thereby placing the position indication $X_M$ at that time into storage at 298. The selector 292 then alternately selects $X_L$ and $X_R$ as determined by automatic sequencing logic 322. Thus in the auto skinning mode, the velocity command signal $V_{COMM}$ corresponds to the square root of the position error E(X), i.e. the distance between the present position of the carriage and the position of the carriage when the end of the workpiece WP reaches the grinding head 100. At that time, the position command $X_L$ or $X_R$ corresponding to the opposite end of the workpiece WP is selected by the automatic sequencing logic 322 thereby generating a command $V_{COMM}$ which moves the carriage C in the opposite direction at a rate corresponding to the square root of the position error E(X). The operation of the various devices implemented by the microcomputer 204 is controlled by automatic sequence logic 322 which is placed in either an auto skinning mode or a manual mode by switches 324, 326, respectively, which are manually selected by the operator.

Figure 7:
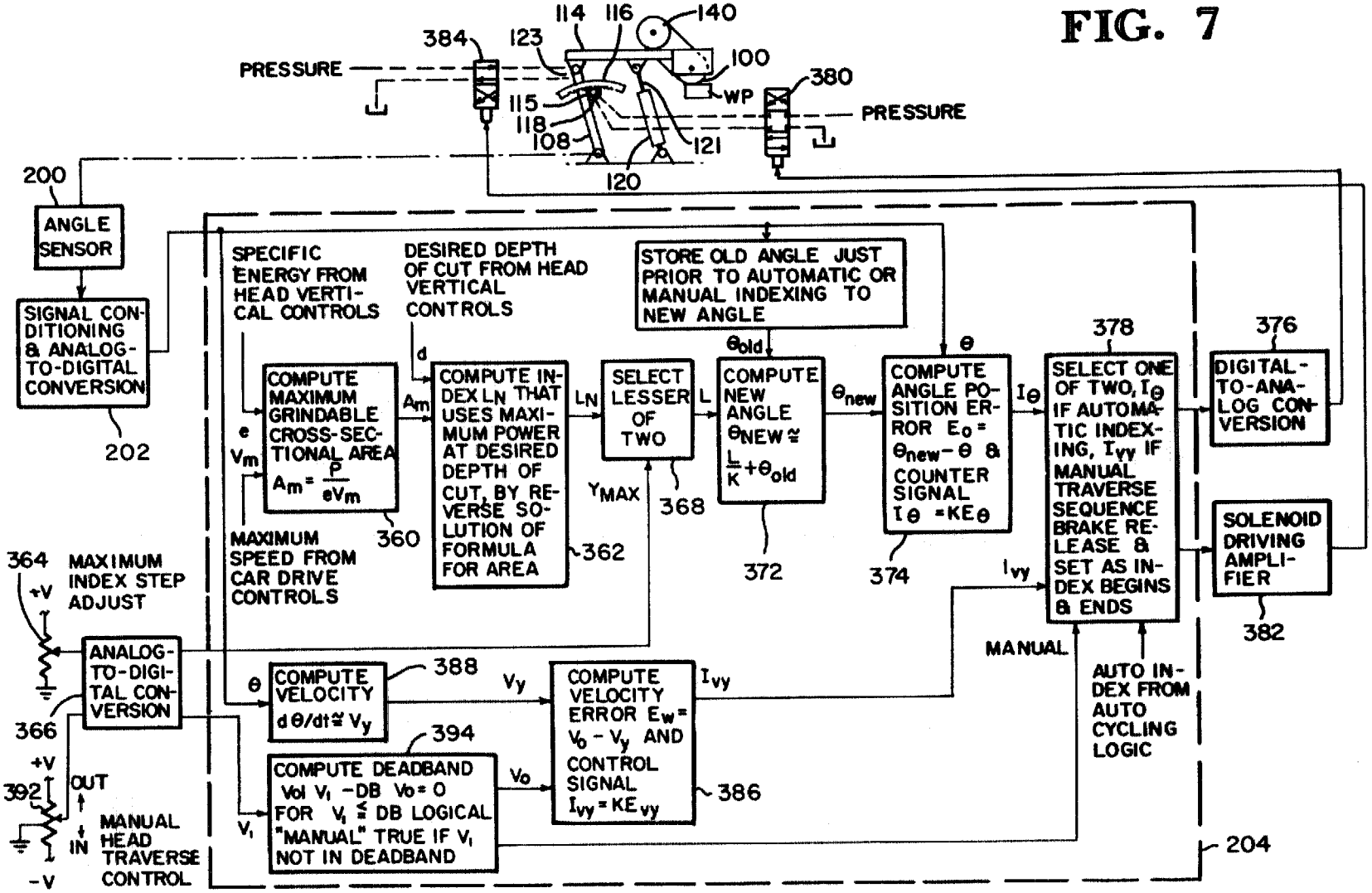
FIG. 7 is a schematic and block diagram of the grinder head traverse control system.

The grinder head traverse control system is illustrated in FIG. 7. The microcomputer 204 calculates a maximum grindable cross-sectional area at 360 from the manually selected specific energy selected by potentiometer 208 and the maximum speed indication $V_M$ from the carriage drive control circuitry (FIG. 6). The maximum grindable cross-sectional area $A_M$ is calculated according to the formula $A_M = P/eV_M$ where P is the power capacity of the motor 140 rotating the grinding head 100. The maximum area is thus selected so that the maximum available power from the motor 140 will be utilized when the carriage is moving at the maximum workpiece speed $V_M$ under specific operating conditions. The transverse width $L_N$ of the longitudinal cut formed in the workpiece WP corresponding to a cut having the cross-sectional area $A_M$ and a depth d as selected by the depth-of-cut potentiometer 206 is then calculated at 362 according to the formula $$A = \tfrac{1}{2}\pi R^2 + \tfrac{1}{2}Ln\sqrt{R^2 - (\tfrac{1}{2}Ln)^2} - Ln(R - d) - R^2\mathrm{Arcsin}\left(\frac{1}{R}\sqrt{R^2 - (\tfrac{1}{2}Ln)^2}\right)$$

The calculated increment $L_N$ may be relatively large for shallow depths of cut and workpiece materials not requiring a great deal of energy to remove a unit volume of a specific material under specific operating conditions. Under some circumstances the increment may be so large that the grinding operation would produce an excessively irregular contour on the surface of the workpiece. Thus, it is desirable to limit the maximum transverse movement of the grinding head 100 to a predetermined maximum value $Y_{MAX}$. The maximum increment $Y_{MAX}$ is manually selected by a maximum index step adjust potentiometer 364 and converted to digital form by an analog to digital conversion device 366. The lesser of the calculated increment $L_N$ and the maximum increment $Y_{MAX}$ is selected at 368 to generate an increment command L. Since the angle sensor 200 measures the angle $\theta$ of the arm 108 with respect to the vertical, the increment L must be converted to an angular increment. For this purpose, the angle O just prior to an incremental transverse movement of the grinding head 100 is stored at 370. The new angle $\theta_{NEW}$ is then calculated at 372 according to the formula $\theta_{NEW}(L/K) + \theta_{OLD}$ where K is a constant corresponding to the length of the arm 108. A position error $E_\theta$ is then computed at 374 to generate a control signal $I_\theta$ which is proportional to the difference between $\theta_{NEW}$ and the current value of $\theta$ as measured by angle sensor 200. In the automatic skinning mode the command $I_\theta$ is applied to a digital to analog conversion device 376 by selector 378 which actuates a servo valve 380 to apply hydraulic fluid to the hydraulic motor 118 thereby rotating arm 108 until the actual angle $\theta$ of the arm 108 is equal to $\theta_{NEW}$ thereby causing the control signal $I_\theta$ to be zero. At the same time, a brake release command is applied to solenoid driving amplifier 382 which actuates the solenoid 384 to release the locking cylinders 123 (FIGS. 1-2). When the position error falls to zero the locking cylinders 123 are once again applied to clamp the arm 108 to the side bars 117.

In the manual skinning and spotting modes the command $I_{VY}$ is selected at 378 and applied to the solenoid 384 through digital to analog conversion device 376. The command $I_{VY}$ is computed at 386 according to a velocity error $E_{VY}$ corresponding to the difference between a manual velocity command $V_O$ and the actual rotational velocity $V_Y$ of the arm 108 which is calculated at 388 by taking the derivative of the $\theta$ with respect to time. The velocity command $V_O$ is derived from a manual head traverse control potentiometer 390 which is converted to digital form by the analog to digital conversion device and applied to a deadband calculator 394. The deadband calculator 394 is provided to prevent a velocity command $I_{VY}$ from being generated responsive to slight offsets of the potentiometers 392. Thus a velocity command $V_O$ is not generated until the potentiometer 392 has been moved in either direction beyond a predetermined value.

Figure 8:
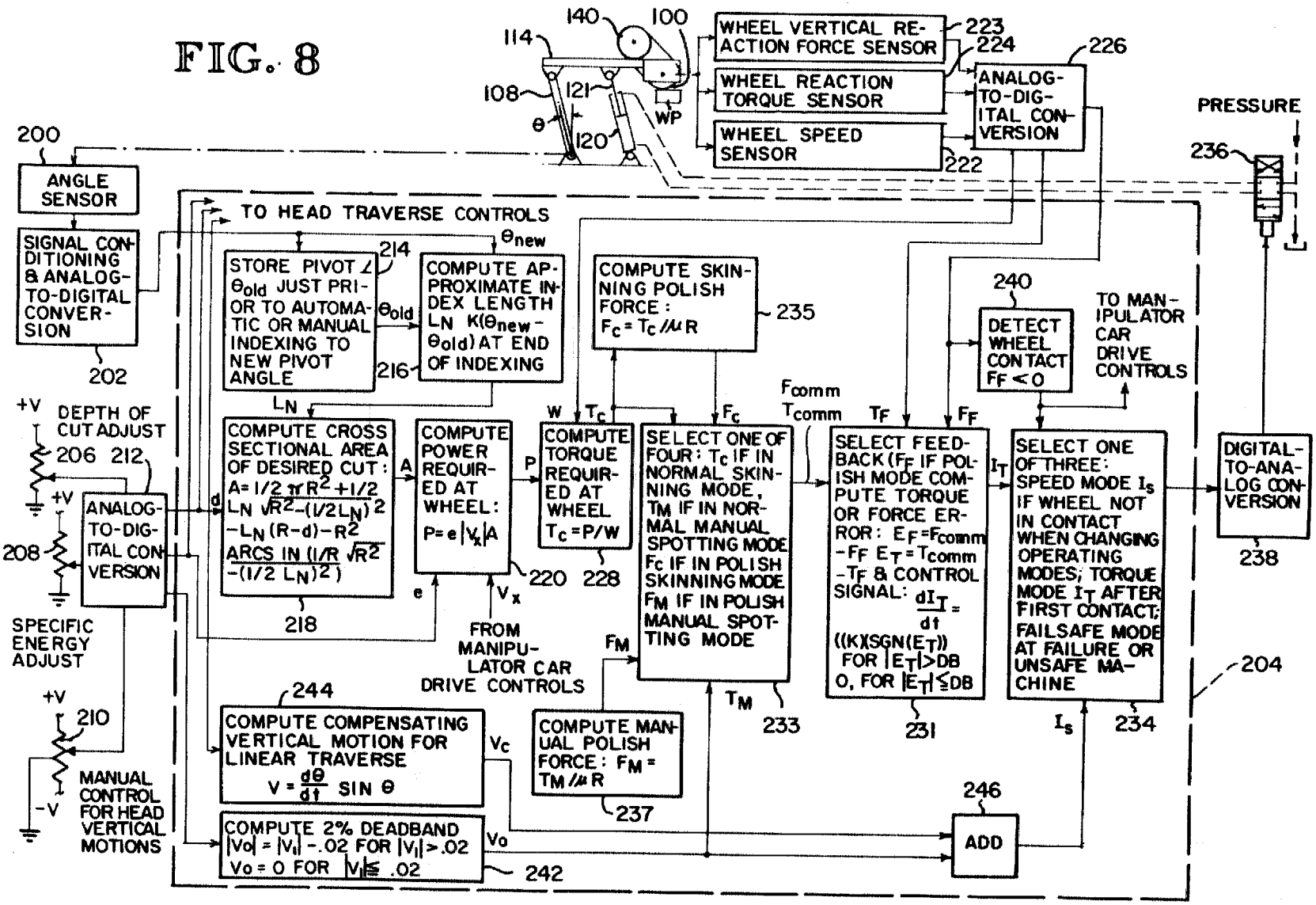
FIG. 8 is a schematic and block diagram of another embodiment of a grinder head vertical axis control system including a polishing system for applying a relatively light grinding force between the grinding head and workpiece.

Another embodiment of the vertical axis control system including a polish mode for applying a relatively light grinding force to the workpiece is illustrated in FIG. 8. Insofar as the major portion of the embodiment of FIG. 8 is identical to the embodiment of FIG. 4, only the additional features will be explained herein. The basic concept of the polish system is that a grinding force command representing the desired force of the grinding head 100 on the workpiece WP in a direction normal to the surface of the workpiece WP is compared with the actual grinding force as measured by a wheel vertical reaction force sensor 223 such as a load cell mounted on the arm 114. A corrective signal is derived therefrom and applied to the servo valve 236 to adjust the pressure in the hydraulic cylinder 120 so that the actual grinding force equals the desired grinding force. In a polish skinning mode the grinding force $F_C$ is calculated at 235 according to the formula $F_C = T_C/\mu R$. The grinding force $F_C$ is sense selected by 233 as $F_{COMM}$ and compared with the actual force signal $F_F$ as measured by the sensor 223 at 231. The comparator 231 generates a control signal $I_T$ in the same manner as the comparator 230 of FIG. 4. In the manual polish mode the force command $F_M$ is calculated at 237 according to the formula $F_M = T_M/\mu R$. Thus the force signal $F_M$ is controlled by the position of the manually actuated potentiometer 210. As with the auto polish mode, the force command $F_M$ is compared with the actual force indication $F_F$ at 231 and applied to the servo valve 236 which controls the grinding force exerted by the grinding head 100 against the workpiece WP. The force command $F_C$ and $F_M$ are selected to produce a relatively light grinding force so that the grinding head 100 loads up with material from the workpiece WP to polish the workpiece WP instead of grinding material from its surface.

The embodiments of the invention in which a particular property or privilege is claimed are defined as follows:

1. A high production grinding machine for conditioning an exposed, generally planar surface on an elongated workpiece comprising:

a grinding station having a rigid frame;

means for providing relative movement between the workpiece and the grinding station along the longitudinal axis of the workpiece;

a powered grinding wheel rotatably mounted about an axis which is parallel to the longitudinal axis of said workpiece;

a first, elongated support arm pivotally secured to said frame about a first axis parallel to the longitudinal axis of said workpiece;

a second, elongated support arm pivotally secured to said first support arm about a second axis parallel to said first axis, said second support arm carrying said grinding wheel;

first actuator means for selectively pivoting first support arm about said first axis;

second linear actuator means having one end pivotally connected to said second arm and the opposite end pivotally connected to said frame, said second actuator means being generally parallel to said first support arm to form a parallelogram structure such that the angle of said second arm with respect to said frame and the position of said grinding wheel in a direction parallel to the longitudinal axis of said first support arm remains substantially constant as said first arm is pivoted about said first axis.

2. The grinding machine of claim 1, wherein said exposed surface occupies a generally horizontal plane and said first support arm projects generally upwardly from said frame and said second support arm projects generally horizontally from said first support arm such that pivotal movement of said first arm about said first axis primarily moves said grinding wheel transversely along the exposed surface of said workpiece and pivotal movement of said second arm about said second axis primarily moves said grinding wheel toward and away from the exposed surface of said workpiece.

3. The grinding machine of claim 1 wherein said grinding station further includes an arcuate rack having a center of curvature coincident with said first pivot axis and wherein said first actuator includes a pinion gear meshing with said rack and rotatably driven by power means mounted on said first support arm such that said first support arm pivots about said first axis responsive to rotation to said pinion gear.

4. The grinding machine of claim 1, wherein the mean positions of said first and second support arms are perpendicular to each other to minimize movement of said grinding wheel perpendicular to each support arm responsive to pivotal movement of the other support arm, whereby pivotal movement of one support arm moves said grinding wheel in one direction while pivotal movement of the other support arm moves said grinding wheel in an orthogonal direction.

* * * * *